US006129099A

United States Patent [19]

Foster et al.

[11] Patent Number: 6,129,099

[45] Date of Patent: Oct. 10, 2000

[54] PALLET WASHING APPARATUS AND METHOD

[76] Inventors: James B. Foster, 1420 Lakewood, Bloomfield Hills, Mich. 48302; Ralph Gary Turnbull, 2901 Sesame St., Howell, Mich. 48843; Jack W. Smylie, 23241 Purdue, Farmington Hills, Mich. 48336

[21] Appl. No.: 08/932,644

[22] Filed: Sep. 17, 1997

[51] Int. Cl.[7] ..... B08B 3/02; B08B 13/00

[52] U.S. Cl. ..... 134/57 R; 134/72; 134/111; 134/125; 134/129; 134/131

[58] Field of Search ..... 134/48, 49, 56 R, 134/57 R, 68, 72, 82, 83, 111, 125, 129, 131, 134, 181, 123

[56] References Cited

U.S. PATENT DOCUMENTS

| | | | |
|---|---|---|---|
| 880,713 | 3/1908 | Blair . | |
| 1,617,833 | 2/1927 | Armstrong . | |
| 1,714,075 | 5/1929 | Carvalho . | |
| 2,229,605 | 1/1941 | Snyder et al. | 134/125 X |
| 2,592,857 | 4/1952 | Chadwick . | |
| 2,651,065 | 9/1953 | O'Connor . | |
| 2,698,627 | 1/1955 | Kearney et al. | 134/72 X |
| 2,714,892 | 8/1955 | Mendenhall et al. | 134/72 |
| 3,090,392 | 5/1963 | Libby | 134/125 |
| 3,098,250 | 7/1963 | Creech | 15/77 |
| 3,144,872 | 8/1964 | Kearney | 134/111 X |
| 3,178,745 | 4/1965 | Kleebauer | 15/77 |
| 3,179,117 | 4/1965 | Gibson et al. | 134/107 |
| 3,289,238 | 12/1966 | Sorenson et al. | 15/306 |
| 3,409,030 | 11/1968 | Schmidt | 134/123 |
| 3,416,545 | 12/1968 | Holzemer | 134/129 |
| 3,421,526 | 1/1969 | Alkire et al. | 134/181 X |
| 3,675,665 | 7/1972 | Sadwith | 134/134 X |
| 3,694,847 | 10/1972 | Hetman et al. | 134/64 R |
| 3,849,820 | 11/1974 | Lang | 15/21 C |
| 3,990,571 | 11/1976 | Kitterman et al. | 134/133 X |
| 4,281,675 | 8/1981 | Pure | 134/131 X |
| 4,739,780 | 4/1988 | Czaja et al. | 134/131 X |
| 4,805,649 | 2/1989 | Nezworski | 134/72 X |
| 4,807,319 | 2/1989 | Poitevin | 134/131 X |
| 4,971,084 | 11/1990 | Smith et al. | 134/181 X |
| 5,052,332 | 10/1991 | Hajek et al. | 134/148 X |
| 5,231,726 | 8/1993 | McKenney et al. | 15/88.3 |
| 5,372,153 | 12/1994 | Dobson | 134/83 X |
| 5,419,349 | 5/1995 | Swain | 134/111 X |
| 5,446,942 | 9/1995 | Whitehorn | 15/302 X |

FOREIGN PATENT DOCUMENTS

| | | | |
|---|---|---|---|
| 2024363 | 1/1980 | United Kingdom | 134/82 |

*Primary Examiner*—Philip R. Coe
*Attorney, Agent, or Firm*—Harness, Dickey & Pierce, PLC

[57] ABSTRACT

A method and apparatus for cleaning articles such as pallets, totes, containers, bins, trays, carts, and other like articles. The apparatus includes a main housing having a conveyor system on which articles are transported into and through a washing chamber. The apparatus is versatile and employs adjustable guide rails to hold in place a wide variety of different sizes and configurations of a wide assortment of articles. A plurality of high pressure, jet-stream spray nozzles rotating at high speeds are supplied with a high pressure wash fluid. The spray nozzles provide rapid, powerful, knife-like jet streams of wash fluid which impact the surfaces of the articles moving through the washing chamber repeatedly to lift and blast off contaminants adhered to the articles. The apparatus is portable and includes a closed-loop water reclamation system having a plurality filter assembly and is environmentally friendly. Contaminant-entrained wash fluid is collected in a collection tank, filtered and supplied back to a clean tank for reuse. The apparatus does not require heated water nor a constant supply of fresh water for operation and has an extremely high throughput capacity to clean large quantities of articles quickly and consistently in a limited time. Optionally, but preferably, a pair of blower assemblies are provided for delivering columns of air which remove liquid on the articles as the articles leave the washing chamber and pass through the drying chamber. In an alternative preferred embodiment the apparatus includes two pairs of air knives which deliver extremely powerful columns of air to dry articles passing through the apparatus.

26 Claims, 7 Drawing Sheets

PALLET WASHING APPARATUS AND METHOD

BACKGROUND OF THE INVENTION

1. Technical Field

This invention relates to a versatile washing apparatus, and more particularly to a self-contained and portable, fully integrated washing and drying system for washing large quantities of a wide range of articles such as pallets, totes, containers, dunnage and other like structures through the controlled application of a high pressure wash fluid, along with the removal of the excess moisture from the article.

2. Discussion

Articles such as pallets, totes, containers, trays, dunnage trays and other like structures are used in a wide variety of applications in many industries to transport quantities of various items. In the food industry such items may include produce, meats, fruits, vegetables and dairy products. Such articles are also used extensively in factories to help transport industrial parts from one work area to another or between plants or from a factory to a warehouse or end user.

As can be appreciated, such articles as pallets, totes and containers often become dirty, especially with repeated use. In the food industry this can be particularly troubling if such articles are exposed to, for example, leaking milk cartons, fruit juice cartons, etc., and then reused without proper cleaning. The reuse of such articles can result in the contamination or damage to the product being transported. As can be appreciated, keeping articles such as pallets, totes, containers and other like structures clean and free from bacteria and odors is therefore particularly important in the food industry. It is also important in other factory settings to maintain such structures clean so that one or more dirty pallets, totes or trays do not transfer dirt and contaminants and potentially damage the product being transported.

Pallets, totes and other like structures often have ribbings and complexly shaped surfaces adapted to hold a wide variety of parts and an assortment of products. Often, the surfaces of such structures include a plurality of recesses, and in some instances very deep cavities, which are difficult, slow and tedious to clean and dry by hand. In many applications, where literally hundreds or thousands of pallets are used, cleaning such pallets by hand, such as with a hand-held spray system, is much too time consuming and not cost effective considering the time that is often required to clean and dry just a single pallet adequately.

In response to the above need to quickly and easily clean large numbers of pallets, totes and other like articles, a number of attempts have been made to provide various forms of apparatuses in an attempt to clean large numbers of such articles quickly, easily and efficiently in an automated fashion. However, previously developed apparatuses designed for cleaning such articles have suffered from a number of drawbacks. One such attempt at providing an automated pallet cleaning apparatus is disclosed in U.S. Pat. No. 5,446,942 to Whitehorn. The apparatus of this patent, however, requires the use of steam as the cleaning agent, together with a large boiler for producing the steam needed in a cleaning operation. As will be appreciated, the use of a steam generator for supplying heated steam requires a certain time for building up pressure and heat. When a large number of pallets or other like articles are to be cleaned, feeding one such article after another through the apparatus does not allow sufficient time to generate the heated steam, and the cleaning must be halted for a period of time to allow the boiler to regenerate the desired pressure. Thus the throughput of the apparatus is limited and may not be sufficient in applications where it is desired to clean hundreds or thousands of pallets or like articles at a time. The use of a large boiler also requires a large amount of power from a standard service, must be permanently located within the plant, is expensive and time consuming to install, is costly to operate and requires extensive maintenance. Also, most importantly, the boiler of the device disclosed in U.S. Pat. No. 5,446,942 calls for only 100 lbs. of pressure, and the steam alone provides no impingement force onto the surface of the article. The steam also generates significant moisture and humidity into the plant, which can cause corrosion and other harmful side effects within the plant's environment.

Other prior art pallet washing devices have relied on the application of heated liquid, such as the apparatus disclosed in U.S. Pat. No. 5,372,153 to Dobson. This patent discloses a pallet washing apparatus having a number of fixed spray nozzles and a heater for supplying heated fluid to the fixed spray nozzles. As will be appreciated, this device also requires a significant amount of electrical power for heating the cleaning fluid. If a boiler is used to heat the washing fluid the same shortcomings described in the Whitehorn U.S. Pat. No. 5,446,942 patent will apply. Obviously, if the apparatus has been powered off for some time, when it is first powered back on some length of time will be required to allow the cleaning fluid to be heated to the necessary temperature before the apparatus can be used. Also, this apparatus requires a constant supply of fresh water, which means it must be permanently located and connected to a fresh water supply. Also, since the fluid needs to be heated before use, only a limited number of pallets or other like articles are able to be cleaned before the fluid holding tank needs to be recharged and the fluid therein heated to a sufficient temperature before an additional quantity of pallets can be cleaned. Thus, the throughput of this apparatus, and virtually all other apparatuses requiring a heated fluid, is severely diminished because of the need to heat the fluid to a sufficient temperature before applying same to the pallet or other article being cleaned. Also, this patent does not address a means to dispose of the contaminants removed from the articles and merely puts the contaminants and contaminated fluid down a drain, which would likely not be allowed by current environmental regulations. Also, the fixed nozzles defined in the patent may not provide an adequate spray pattern for articles of varying sizes and shapes, and may not effectively clean a variety of different articles such as pallets, totes and dunnage. Finally, this patent provides no means to dry the article or remove the excess moisture, which would restrict the articles or pallets from being stacked or put back into service until they are air dried.

Previously developed apparatuses for washing pallets and other like articles have also suffered from one or more other drawbacks or disadvantages. One such disadvantage is the lack of portability. Often, such as in factories, it would be much easier to transport the pallet washing apparatus to a specific area of a plant or factory rather than transporting hundreds or thousands of pallets to the apparatus, as is often required. Other pallet and tote cleaning apparatuses are generally not readily portable. This is especially so with apparatuses that require a heated fluid source, and therefore require a large electrical service and permanent electrical and water connections. These systems present significant maintenance procedures and require specialized training and knowledge to operate. Any apparatus requiring such a large service and permanent connections will generally be very large and restricted to one part of a building, plant or factory where such service and connections are available. These systems take up a large area of valuable floor space and often require special plumbing, venting, water treatment and other special accommodations to the plant facilities. These systems are generally made for one specific type of article and have no versatility to clean a variety of different articles or shapes. They also generally clean through submersion and part agitation, clean with heavy solvents and chemicals, require extensive washing and rinsing chambers, and are limited in throughput capacity.

Another drawback of many pallet and tote cleaning apparatuses is the need for a permanent, constant or periodic supply of fresh water as well as the need for a drain for disposing the contaminant entrained water. The need for permanent or frequent access to a water supply to frequently recharge a water container of the apparatus, as well as the need for frequent access to a drain, can severely limit the use of such a cleaning apparatus within a facility.

Yet another problem presented by many previously developed apparatuses for cleaning pallets and totes is the lack of a collection system for collecting and filtering the contaminant-entrained wash fluid before such fluid is drained. For environmental reasons, it is undesirable to simply drain the contaminant-entrained wash fluid from the apparatus without some form of filtering process which removes contaminants which might be harmful to the environment.

Perhaps the most significant drawback, however, with previously developed pallet, tote and container washing apparatuses is the inability to completely clean the surfaces of such articles. As explained above, the surfaces of pallets, containers and totes are often complexly shaped with numerous recesses, pockets, etc., which are often difficult to clean with a spray system having fixed spray nozzles with limited spray coverage and/or a spray system of only a limited pressure, and little impingement force. With some previously developed apparatuses, it has been necessary to spray down various areas of a pallet or like structure with a hand held spray wand after the pallet has passed through the apparatus for cleaning. Spraying with a hand-held wand has often been necessary to reach the various recesses, grooves, pockets, etc. in such articles effectively. As explained above, however, manual spraying with a hand-held wand is very time intensive, adds significantly to the overall cost of cleaning, and is subject to operator error, judgement and has no consistency of cleaning.

It is therefore a principal object of the present invention to provide a versatile apparatus for quickly and efficiently cleaning and drying articles such as pallets, totes, containers and other like structures automatically, and with a minimal degree of operator intervention.

It is still a further object of the present invention to provide an apparatus for washing pallets, totes, containers and other like structures quickly and easily with the use of a wash fluid delivered under high pressure from a spray system incorporating a plurality of spray nozzles, and where two or more of the spray nozzles are rotated at relatively high speeds, which cause a plurality of high pressure jet streams to impact every square inch of the surface of the article to be cleaned a multiple number of times and provide a knife-like cleaning action, and which further does not require the wash fluid to be heated.

It is a further object of the present invention to provide effective cleaning through a plurality of high pressure fluid jet streams to blast off dirt and contaminants without the use of scrubbing brushes or other mechanical devices.

It is still another object of the present invention to provide an apparatus for washing pallets, totes, containers and other like articles which incorporates a closed-loop water reclamation system for filtering contaminant-entrained wash fluid, filtering the wash fluid and resupplying the wash fluid to a container for reuse, such that a continuous, external supply source of water and a water drain are not necessary to the operation of the apparatus once the container of the apparatus has been charged or filled with a predetermined quantity of water. Such features would permit the apparatus to be used in various areas of a factory, plant, warehouse, etc. where a fresh water supply and a drain are not available.

It is still another object of the present invention to provide an apparatus for washing pallets, totes and other like articles which has a very high throughput capacity for cleaning very large numbers of such articles in a limited amount of time.

It is a further object of the present invention to provide a "turn key" system that merely needs a simple garden hose connection to a water line and a standard 240 volt service electrical connection for operation.

It is a further object of the present invention to have a completely versatile system that is able to clean and dry a wide range of different products of varying sizes and configurations with only simple mechanical adjustments being required to portions of the apparatus.

It is a further object of the present invention to provide a means to thoroughly dry and remove the majority of moisture from pallets, totes and other like articles as they exit a washing chamber of the invention.

SUMMARY OF THE INVENTION

The above and other objects are met by a pallet and tote washing and drying apparatus and method in accordance with preferred embodiments of the present invention. The apparatus of the present invention includes a main housing forming a washing chamber. At the entrance to the washing chamber is a conveyor system which feeds pallets, totes, containers and other like articles into and through the washing chamber as such articles are loaded onto the conveyor by an individual. Once inside the washing chamber, the articles are cleaned by a high pressure spray system which produces a plurality of rotating, moving, high pressure jet streams of wash fluid which repeatedly impinge all the surfaces of the pallet and tote. Auxiliary overhead spray nozzles are also disposed at an upper area of the washing chamber for directing the wash fluid under high pressure down along one edge of each article as it moves on the conveyor through the washing chamber.

The spray system includes one or more pairs of spray arms which each include a plurality of jet stream spray nozzles. The spray arms are rotated at a relatively high speed which produces a plurality of jet streams within the washing chamber which repeatedly and forcefully impact the surfaces of the articles and provide a knife-like cleaning action. The spray nozzles are further orientated, in one preferred embodiment, such that the jet streams strike the surfaces of the pallet at a predetermined angle of impingement to optimize the knife-like cleaning action. The spray system effectively cleans crevices, grooves, pockets and recesses of a variety of complexly shaped articles. Importantly, the high pressure, knife-like jet streams produced by the spray system perform the above-described cleaning action without the need for a heated fluid and without the need for detergents, although detergents or other additives may be added to achieve certain results. This significantly reduces the overall cost of the apparatus making it much more affordable than other large sophisticated systems and permits it to be used with standard electrical services. Also importantly, the ability to use the wash fluid without first heating the fluid provides the apparatus with a significantly higher throughput capacity than systems requiring a heated fluid, and is much more efficient to operate.

In the preferred embodiments the apparatus also includes a guide rail assembly which enhances the versatility of the apparatus and which is quickly and easily adjustable either manually or automatically by an individual. The guide rail assembly independently supports articles having various widths and configurations in an upright orientation as the articles are carried along the conveyor through the washing chamber. In this manner the washing apparatus has the versatility to quickly clean a wide variety of articles having significantly varying dimensions and shapes without having to purchase a separate machine to accommodate a different sized article and without any disassembly or modification to the apparatus other than the above-described simple manual or automatic adjustment of the guide rail assembly.

The apparatus of the present invention further includes a closed-loop water reclamation system for filtering and reusing wash fluid and conserving the amount of water consumed in the washing operation. In this manner there is no need for the apparatus to be permanently located near a drain such that contaminant-entrained washing fluid has to be continuously drained from the apparatus as in other washing systems previously described. Instead, the apparatus incorporates a tank for holding a quantity of clean wash fluid which is supplied to the spray assembly via a high pressure pump. As the wash fluid impacts the articles within the washing chamber, the wash fluid becomes entrained with contaminants and drains into a collection tank integrated with the sides of the wash chamber and disposed underneath the full length conveyor system. The contaminant-entrained wash fluid is then strained and pumped to one or more filter assemblies which removes the contaminants from the wash fluid. The resulting clean wash fluid is then pumped back into the clean tank for reuse. This arrangement also provides significant environmental benefits because wash fluid contaminated with environmentally harmful contaminants is not put into a drain or allowed to enter the ground water but is instead filtered thoroughly before being reused. When the washing apparatus is finally drained, the fluid can most likely be put directly into the drain as the harmful contaminants will have been removed by the filter system.

A significant advantage of the apparatus of the present invention is its portability and its ability to be used without requiring a constant supply of fresh water, and without the need for the apparatus to be located adjacent or permanently connected to a drain to be able to continuously drain contaminated wash fluid. The apparatus is a self-contained, compact, movable system. Accordingly, all that is needed is a standard 240 v, three-phase electrical connection for supplying power to the apparatus and an ordinary garden hose hook-up to fill a clean wash fluid holding tank with a wash fluid such as water. Because of its ease of movability, the apparatus can be moved to various parts of the factory, plant or other work area where large quantities of pallets, totes, etc. may be located, rather than requiring all such articles to be brought to a central location for cleaning and then returned to the work areas where they are used. The portable apparatus is also compact and takes up little plant floor space and can be stored when not in use.

In the preferred embodiment the apparatus also incorporates a plurality of elongated brush assemblies at input and output ends of the washing chamber and within the washing apparatus to contain the wash fluid within the washing chamber during operation of the apparatus. One or more pairs of fans or air knives are also disposed adjacent the output side of the washing chamber or within a drying chamber of the apparatus for providing a high pressure air flow which substantially dries the pallets as they exit the washing chamber. Air knives with and without heat can easily be substituted for the blow off fans to provide more forceful air flow to provide more complete and thorough drying.

In the preferred embodiments the various functions of the apparatus are controlled by a programmable logic controller (PLC) which synchronizes the operation of the various components. A detection system disposed at the input side of the washing chamber detects when an article has been placed on the conveyor at the input side. The PLC then turns on the spray system and initiates spinner arm rotation and turns on the fan or air knife assemblies as the conveyor system begins to feed the article into the washing chamber. If a subsequent article is not detected by the detection system within a short predetermined time, then the PLC turns off the spray system, rotation of the spinner arm is stopped, and the fans or air knifes are turned off. As soon as the detection system detects the presence of another article at the input side of the washing chamber, the PLC again starts the spray system. The spinner arm rotation begins and the fans or air knives will be turned on. In this manner power is conserved, as well as wear and tear on the spray system component parts. The PLC also monitors all the maintenance functions of the apparatus and displays a wide range of messages on a digital display screen to make the system user friendly to operate.

BRIEF DESCRIPTION OF THE DRAWINGS

The various advantages of the present invention will become apparent to one skilled in the art by reading the following specification and subjoined claims and by referencing the following drawings in which:

FIG. 8 is a side view of an alternative preferred embodiment of the present invention incorporating a plurality of high power air knives at an output end of the invention;

DETAILED DESCRIPTION OF THE PREFERRED EMBODIMENTS

Figure 1:
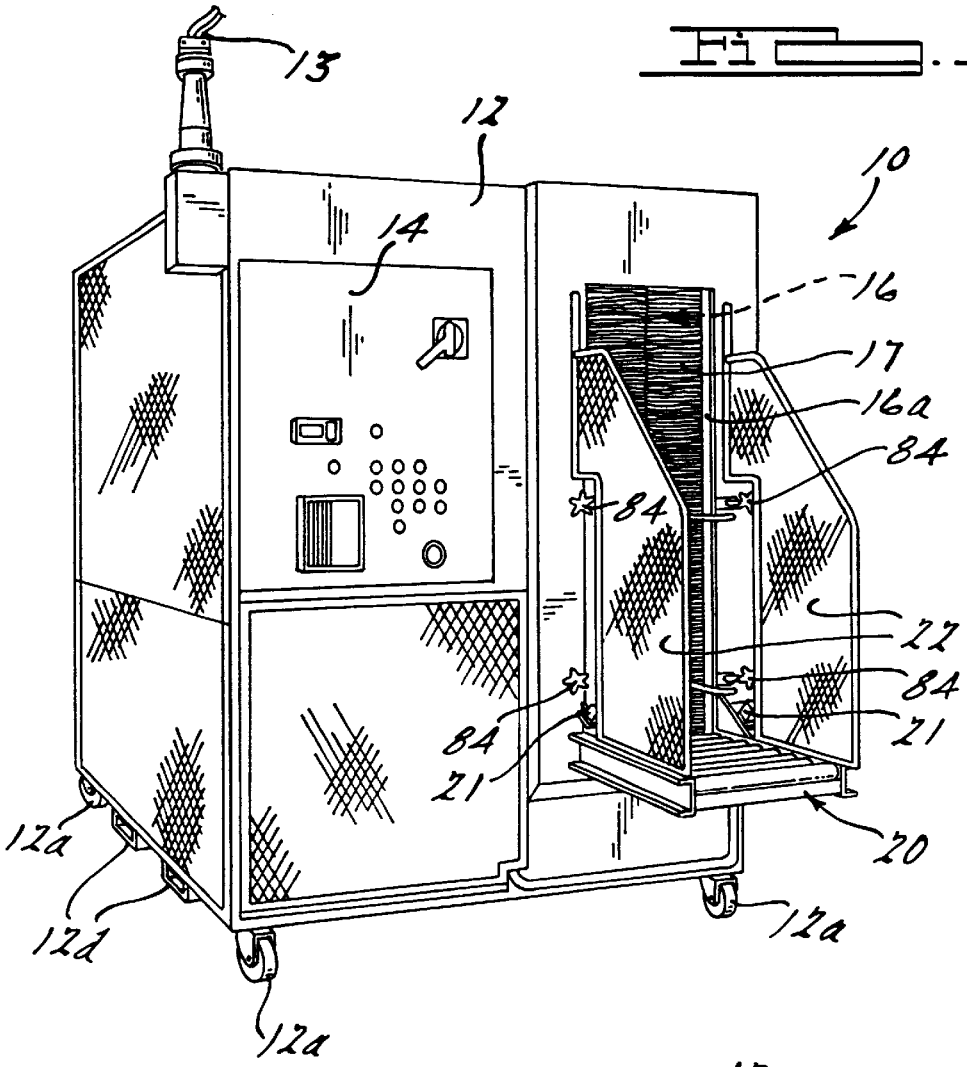
FIG. 1 is a front perspective view of a preferred embodiment of the present invention.

Referring to FIG. 1, there is shown an apparatus 10 in accordance with a preferred embodiment of the present invention for washing pallets, totes, containers, trays and other like articles. It will be appreciated immediately, however, that while the apparatus 10 is primarily intended for washing pallets, totes, trays, containers and like articles, that a wide variety of other articles having dimensions similar to pallets and like structures could also be cleaned provided same are not fragile and/or readily susceptible to breakage when impacted by a high pressure wash fluid. Also, it will be appreciated that the apparatus could easily be used to clean hospital carts, bulk containers, trash receptacles, and virtually any other object which is difficult or time consuming to wash by hand or with hand-held cleaning implements or whose shape and or varying sizes make it impractical or impossible to clean in conventional parts washing equipment that is less versatile and much more part specific than the present invention.

The apparatus 10 includes a main housing 12 supported above ground by a plurality of heavy-duty casters 12*a*. A pair of optional tubular steel members 12*d* are welded to a portion of the frame of the main housing and spaced to accept the tines of a forklift. Although the apparatus 10 weighs on the order of around 6,000 lbs. 8,000 lbs., the casters 12*a* enable the apparatus 10 to be pushed by one or more individuals or moved by various forms of factory equipment (e.g., a hi-lo) within a factory, plant, warehouse or other work area. Thus, the apparatus 10 can be moved if it is more efficient to move the apparatus to several different areas of a work place rather than bringing all of the articles which need to be cleaned to the apparatus 10 at one location within the work place.

The apparatus 10 receives electrical power from a suitable electrical cable 13 via a quick disconnect plug and further includes a control panel 14 for enabling an individual to initiate and control the operation of the apparatus 10, which will be described in greater detail momentarily. The housing 12 includes an internal washing chamber 16 (visible in FIG. 4) which is closed off at an input end 16*a* by one or more first brush assemblies 17. With brief reference to FIG. 2, an output end 16*b* of the washing chamber 16 may be blocked off by one or more second brush assemblies 18. The output end brush assembly 18 also functions to wipe off residual water from the articles before the articles pass through the blow off fan assemblies 24.

With reference to FIG. 1, an auxiliary, non-powered roller assembly 20 is provided for assisting the individual in loading pallets, totes, and other like articles into the washing chamber 16. A pair of parallel screens 22 further assist the individual in loading articles in the event an article should begin to tip over when first placed on the roller assembly 20. A detection system 21 comprising a pair of infrared or electric eye sensors provide a signal indicating the presence of an article to be cleaned as soon as an article breaks the sight path between the sensors.

Figure 2:
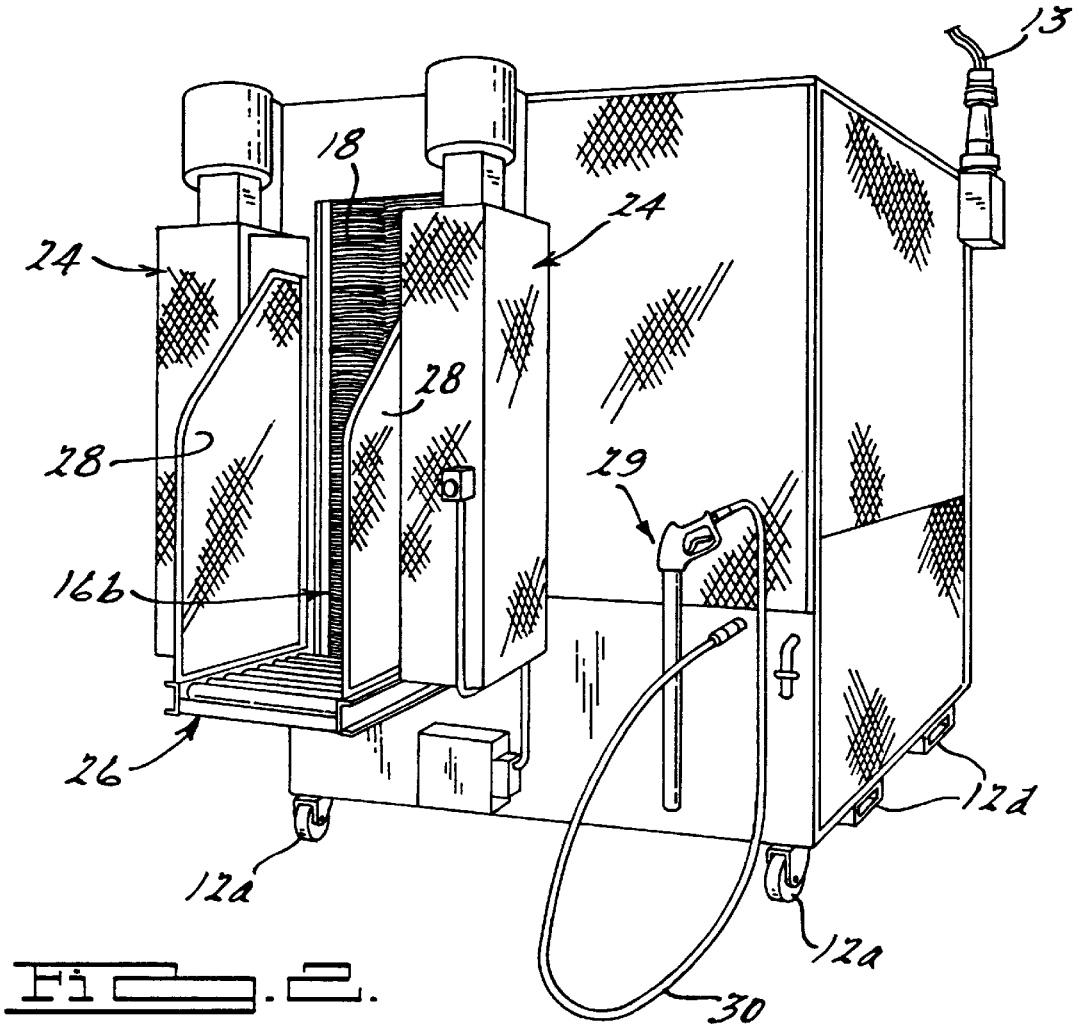
FIG. 2 is a rear perspective view of the apparatus of FIG. 1.

With further reference to FIG. 2, adjacent the output end 16*b* of the washing chamber 16 are one or more pairs of opposed fan assemblies 24. Each of the fan assemblies 24 generates a powerful vertical column of air up to approximately 800 cfm onto the surface of the articles at which the airflow is directed. This produces a knife-like drying action against the exposed surfaces of an article as the article exits the washing chamber 16. The fan assemblies may also be located within a drying chamber adjacent to the washing chamber, separated by one or more brushes to restrict the flow of water from the washing chamber into the drying chamber. The fan assemblies may also be located with a separate modular drying unit that may be rolled up to and integrated with the washing apparatus. The drying unit may also be moveable along a horizontal plane to enable it to be located in close proximity to the article in order to concentrate the airflow for maximum drying results. The blowers may also be rotated so as to alter the direction and angle of the air flow onto the surface of the part to achieve desired results. A second auxiliary, non-powered roller assembly 26 receives the cleaned, substantially dry articles as they exit the washing chamber 16. A pair of upright screens 28 help to prevent the articles, which at this point are standing upright on one end, from falling over prior to an individual gripping the article and lifting it off the roller assembly 26.

Also illustrated in FIG. 2 is an optional, manual spray wand 29. The spray wand 29 receives clean wash fluid from a supply hose 30 which is in communication with a clean wash fluid conduit (not visible in FIG. 2). The spray wand 28 enables an individual to spray down miscellaneous articles which may need cleaning but which are not of suitable dimensions to feed through the apparatus 10 or may be used for concentrated spray cleaning of a particularly dirty article. This can be done over the output conveyor so as to collect the wash fluid run-off in the collection tray.

Figure 3:
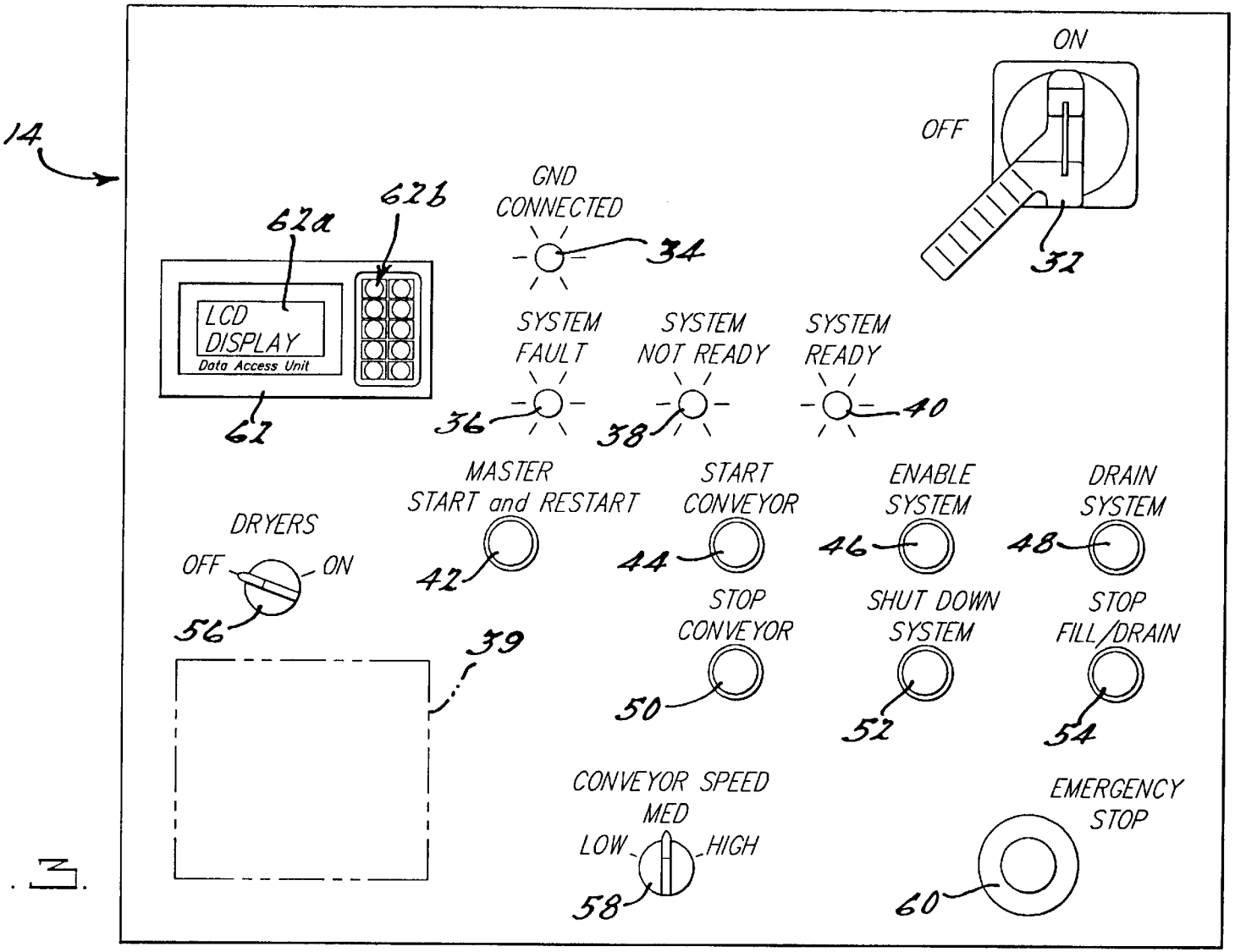
FIG. 3 is an enlarged view of the control panel of the apparatus.

Referring now to FIG. 3, an enlarged view of the control panel 14 is shown. The control panel 14 includes a master switch 32 for electrically connecting the apparatus 10 to the power source. This switch must be turned to the "ON" position before the apparatus 10 can be powered up. Once moved to the "ON" position, the "GND CONNECTED" light 34 is illuminated indicating that the apparatus 10 is electrically coupled to ground. An indicator 36 is provided for indicating a "SYSTEM FAULT" should an error in the operation of one or more components (to be described in the following paragraphs) be detected. A "SYSTEM NOT READY" indicator 38 is illuminated while a programmable logic controller (PLC) 39, which controls the various motors, pumps, electrically actuated valves, and other functions of the apparatus 10, performs various diagnostic self-tests prior to beginning operation of the apparatus 10. A "SYSTEM READY" indicator 40 is illuminated if the apparatus 10 is ready for operation.

With further reference to FIG. 3, a "MASTER START AND RESTART" push button switch 42 is provided for starting the apparatus 10. This initiates the various self-tests mentioned above. A "START CONVEYOR" pushbutton switch 44 is provided for enabling the conveyor system to be started but conveyer will not operate until electric eye 21 is broken. An "ENABLE SYSTEM" pushbutton switch 46 permits the apparatus 10 to be charged with a sufficient quantity of fresh water if a clean tank of the apparatus 10 is empty or unacceptably low in wash fluid. The ENABLE SYSTEM pushbutton 46 must be pressed before any other functions can be selected. When the apparatus 10 is ready for operation, the SYSTEM READY indicator will be illuminated. A "DRAIN SYSTEM" pushbutton switch 48 permits an "automatic drain and fill" routine to be initiated when it is desired to flush out the existing wash fluid held by the apparatus 10 and re-fill the clean tank of the apparatus 10 with fresh water. The automatic drain mode routes all the water in the system through the filtering system a final time to ensure that contaminates are not allowed to enter the drain and to employ the highest level of environmental safeguards.

With further reference to FIG. 3, a "STOP CONVEYOR" pushbutton switch 50 is provided to immediately stop the conveyor of the apparatus 10. A "SHUT DOWN SYSTEM" pushbutton switch 52, when depressed, shuts down the operation of the entire apparatus 10. When this pushbutton is depressed the conveyor will stop moving, the spray system of the apparatus 10 will stop operating, the rotation of the spinner arms will be halted and the fan assemblies 24 will be turned off. A "STOP FILL/DRAIN" push button switch 54 is also provided for stopping the automatic drain and fill operation if this operation needs to be stopped immediately for some reason. A rotary ON/OFF switch 56 is provided for turning on and off the fan assemblies 24, which are denoted on the control panel 14 by the term "DRYERS". A three position rotary switch 58 is provided for enabling an individual to select the speed of the conveyor. The "LOW" position causes a speed of about one inch per second to be selected. The "MED" causes a conveyor speed of about two inches per second to be selected and the "HIGH" position selects a conveyor speed of about three inches per second. For extremely dirty pallets, totes, etc., selecting the "LOW" position will provide the greatest cleaning action since the conveyor will be moving at its slowest speed and each article passing through the apparatus 10 will be subjected to the washing action of the spray system for the longest possible time period and will be impacted by the jet spray a greater number of times. It will be appreciated that these conveyor speeds could be easily modified if a wider range of conveyor speeds is expected to be needed for any reason.

An "EMERGENCY STOP" pushbutton switch 60 is provided for immediately halting all operational functions of the apparatus 10. Lastly, a "DATA ACCESS DISPLAY SCREEN UNIT" 62 is provided which provides the individual with a visual indication of various operating parameters, fault conditions and maintenance items, and further provides a means for allowing an operator to bypass certain "non-critical" faults and continue operation of the apparatus 10. For "critical" faults and safety hazards, however, a specific security code must be entered at the keypad portion 62*b* of unit 62 before operation of the apparatus 10 can continue. With a critical fault, the entire apparatus 10 is shut down by the PLC 39. This includes all of the motors and pumps which may have been operating at the moment the fault occurred. A non-critical fault does not cause the apparatus 10 to shut down but rather results in the display of a fault condition message on the display portion 62*a* of the data access unit 62. A non-critical fault might indicate a filter bag in the filter assembly of the apparatus 10 in need of being changed. A non-critical fault, however, still requires the operator to acknowledge the fault condition at the data access unit 62 by depressing one or more appropriate buttons at the keypad 62*b* to override the fault condition message at the next idle mode of the washing operation. If the non-critical fault is not eventually corrected, however, it will eventually head to a critical fault condition and shut down the system.

Figure 4:
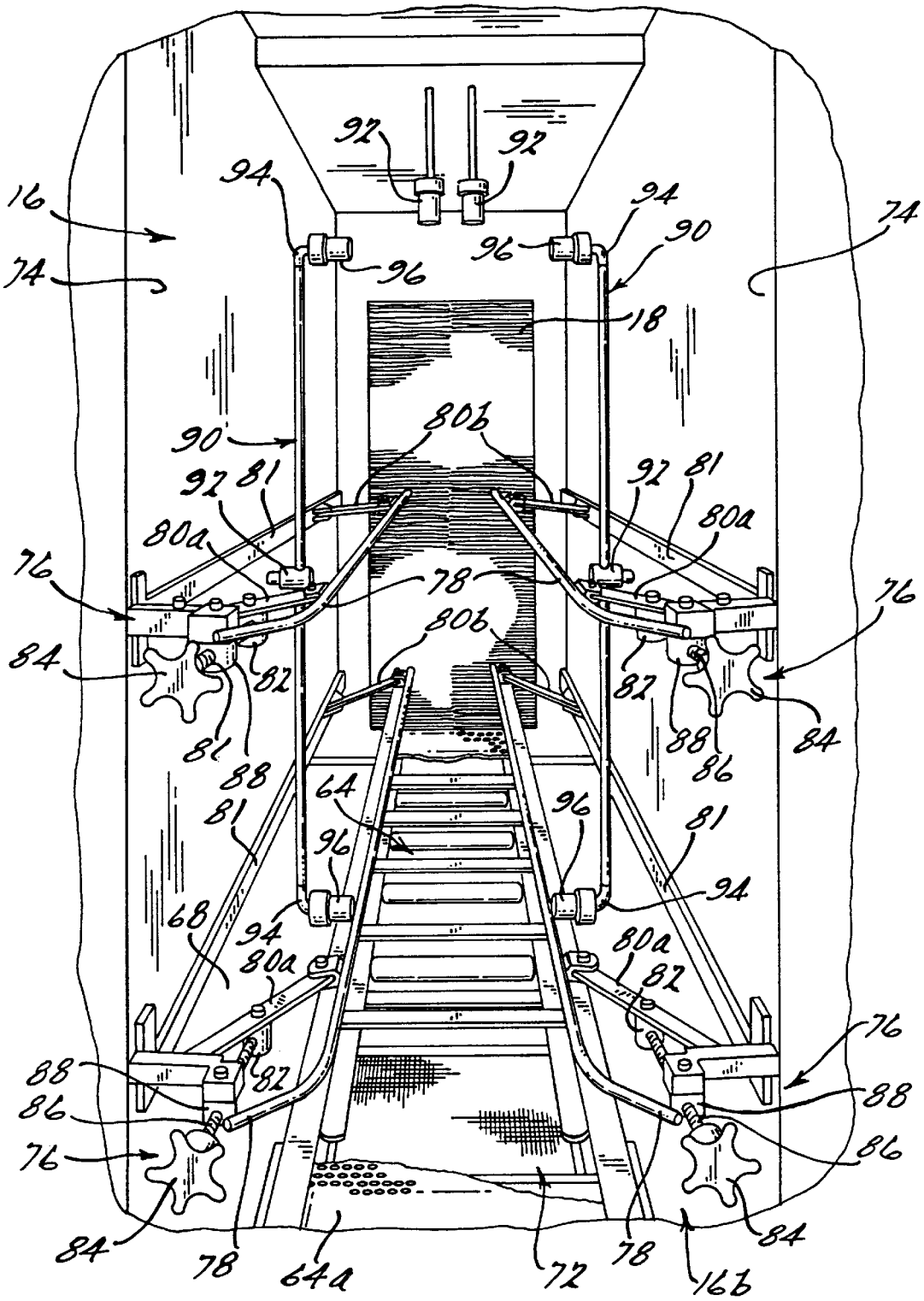
FIG. 4 is a view looking into the washing chamber from the inlet end thereof with the brush assembly at the input end of the washing chamber removed.

Referring now to FIG. 4, the washing chamber 16 can be seen when looking into the input end 16*a* of the chamber. It will be appreciated that the first brush assembly 17 is not illustrated but that the second brush assembly 18 is visible at an output end 16*b* of the chamber 16 or between the washing chamber 16 and the drying chamber, not shown, of washing apparatus 10. A conveyor system 64 is provided for carrying articles into and through the washing chamber 16. The conveyor system 64 is powered by a preferably 0.5 hp–1.0 hp motor and includes preferably a friction belt 64*a* entrained around a pair of drums (not shown), one of which is driven by the above-mentioned motor. The friction belt 64*a* is preferably about 14 inches wide, but it will be appreciated that the width could vary significantly. The friction belt 64*a* may also include a plurality of "dogs" or other like members to assist in moving articles through brush assembly 18. The conveyor surface presented by the friction belt is approximately 8 feet in length, although it will be appreciated that a greater or lesser conveyor surface could be presented depending upon the spacing of the drums around which the friction belt 64*a* is entrained. As mentioned previously, the conveyor system 64 is integrated with a pair of auxiliary, non-powered roller assemblies 20 and 26 shown in FIGS. 1 and 2, respectively, to aid loading and unloading of articles onto the conveyor system 64.

Figure 5:
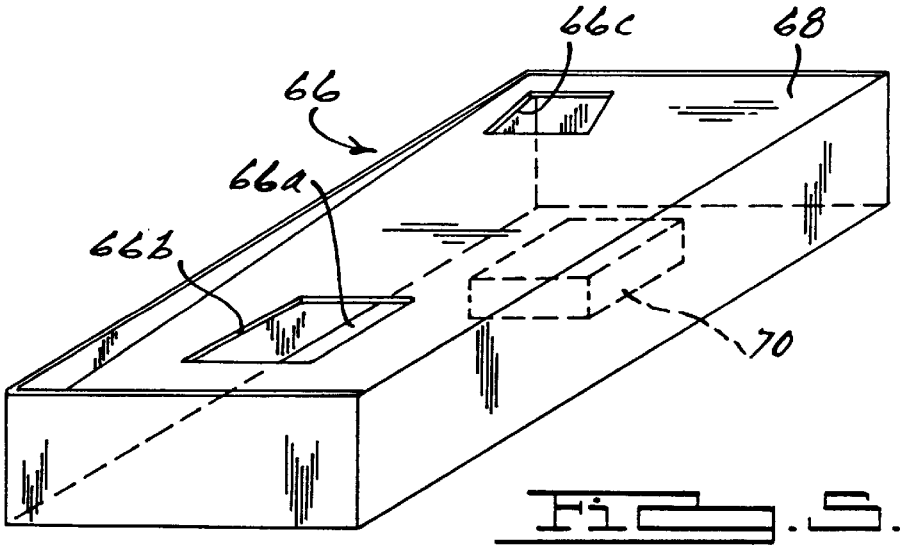
FIG. 5 is a perspective view of the collection tank of the apparatus.

With further reference to FIGS. 4 and 5, below the conveyor system 64 is positioned a collection tank 66 for collecting contaminant-entrained wash fluid draining off the articles being cleaned, the interior walls of the washing chamber 16 and the conveyor system 64. The collection tank 66 is preferably of a polyethylene die-cut and welded construction. Alternatively, this component could be constructed from fiberglass or stainless steel. The collection tank 66 is manufactured with an integral funnel-type top 68 that is contoured and is secured to interior sides of chamber of the main housing 12 under the conveyor system 64 and extending below the full length of the conveyor system 64. Thus, all of the wash fluid discharged in the washing chamber 16 drains into and is collected within the collection tank 66. A sump area 70 is also formed by a tapered bottom wall 66*a* of the collection tank 66 to aid in draining the tank 66 and in the operation of the floats to automatically monitor water levels. A first opening 66*b* permits contaminant-entrained wash fluid to drain into the interior area of the collection tank 66. A second opening 66*c* permits a pair of floats (shown in FIG. 7) to be disposed inside the collection tank 66.

Figure 6:
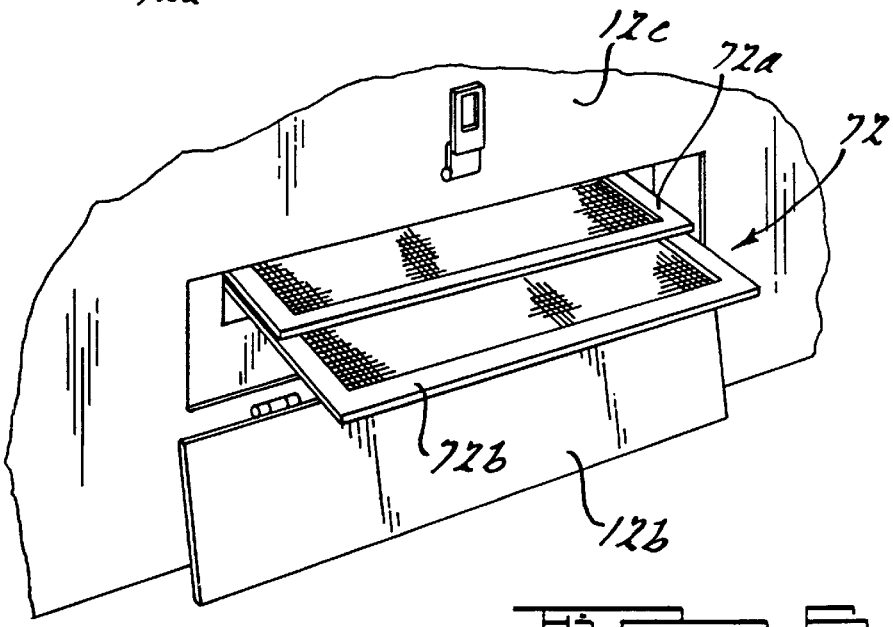
FIG. 6 is a perspective view of the right hand side wall of the apparatus illustrating the slidably removable strainers.

With further reference to FIGS. 4 and 6, in the collection tank 66, and accessible through a door 12*b* in a right side wall 12*c* of the main housing 12, is a strainer assembly 72 placed above tank access opening 66*b*. The strainer assembly 72 comprises a plurality of mesh screens or filters 72*a*, 72*b*, one on top of the other. The top screen 72*a* includes openings preferably about 0.25 inch square for collecting large debris which has been removed from the articles during cleaning. The lower screen 72*b* includes smaller mesh openings, preferably about 0.125 inch square openings, for collecting even smaller debris which has passed through the top screen. Both of the screens are slidably removable independently of one another for cleaning. Additional screens or mesh filter pads may also be employed to achieve additional filtration. The funnel-type top 68 of the collection tank 66 functions to direct the contaminant-entrained wash fluid through the strainer assembly 72 before the fluid enters the collection tank 66, through access opening 66*b*.

With further reference to FIG. 4, the walls of the washing chamber 16 are preferably insulated with a one inch expanded polystyrene (EPS) foam panels 74. The foam panels 74 provide a sound deadening function, thus greatly reducing the noise generated by the high pressure jet streams hitting the internal walls of the washing chamber 16 and the articles passing therethrough, and add stability to the structure of the washing apparatus.

Also visible in FIG. 4 is one or more pairs of guide rail assemblies 76 for holding articles passing through the washing chamber 16 in an upright orientation while the articles are moved on the conveyor system 64. Each guide rail assembly 76 includes a guide bar 78 which is pivotally secured via a pair of links 80*a*, 80*b* to a support member 81. A manual or automatic adjusting knob 84 has a threaded screw portion 86. This knob may also be a crank or some other similar device, and may be controlled automatically with a small electric motor. The threaded screw portion 86 extends through a threaded, fixedly disposed block 88 and is coupled to link 80*a* at a midpoint thereof via a mounting block 82. Rotating the adjusting knob 84 clockwise in the drawing of FIG. 4 causes the links 80*a*, 80*b* to be pivoted such that the guide bar 78 is urged closer toward the vertical wall of the wash chamber 16 to which it is supported. Conversely, rotating the adjusting knob 84 in the counter clockwise direction causes the guide bar 78 to be urged away from the wall. In this manner all guide bars 78 can be quickly and independently controlled and easily adjusted to accommodate articles having widely varying widths, shapes and configurations, and can be moved to close proximity of the article no matter where the recesses or providing areas may fall. The guide bars 78 help to maintain the articles in a mostly upright orientation so that the article being cleaned does not lean into the rotating spinner arm assemblies and to insure that all surfaces of the article to be cleaned and dried are presented most efficiently and at the correct angle of impingement. The guide bars also maintain the articles in the proper orientation so that water collected within grooves, pockets or recesses during the washing phase is allowed to drain prior to entering the drying cycle. Articles such as totes or containers may be angled slightly to aid the draining process.

With further reference to FIG. 4, the washing chamber 16 also encloses a portion of the spray system of the apparatus 10. The spray system is comprised of a high pressure pump (disclosed in schematic fashion in FIG. 7) capable of supplying fluid at a pressure of preferably about 1400 psi to one or more pairs of spray arms 90 and one or more fixed or rotating spray nozzles 92 mounted overhead in the washing chamber 16. Other embodiments of the present invention also call for one or more fixed or rotating spray arms located below a mesh or chain type conveyor with an open middle to deliver pressurized fluid into an inverted container traveling along the open conveyor. Each of the spray arms 90 is formed by stainless steel conduits which receive wash fluid through a coupling 92, the coupling 92 being in fluid communication with a rotary union (not shown). Each of the couplings 92 are driven rotationally by a motor (shown schematically in FIG. 7) at a speed of between about 100 rpm–800 rpm, and more preferably at a speed of about 400 rpm. At each end of the spray arm 90 is an elbow 94 welded to its associated conduit. Secured to each elbow 94 is a jet-stream spray nozzle 96 which produces a knife-like jet stream spray. Each of the spray nozzles 96 are further orientated such that the jet stream spray emitted therefrom forcefully impacts the surfaces of the articles passing through the washing chamber 14 at an angle of between about 10°–45°, and most preferably at an angle of about 20°. The angle of 20° is the angle which has been determined to produce the most effective "knife-like" cleaning action to break lose and lift contaminants from the surfaces of articles passing through the washing chamber 16. The jet stream spray nozzles 96 each produce a fan spray of preferably approximately 5° and have a fluidic cartridge which produces an oscillating action, which provides movement and agitation of the water flowing therethrough. The oscillating action increases the impact of the jet spray by an estimated 50% to provide an extremely strong, knife-like scrubbing action that blasts the contaminants from the surface of the article. When coupled with the rapid rotational speed at which the spray nozzles 96 are rotated by the arms 90, every square inch at the article is repeatedly impacted by the plurality of jet stream sprays a multiple number of times by an extremely forceful knifelike cleaning action onto the surface of the article to be cleaned. Each of the jet stream nozzles 96 are commercially available from the Spraying Systems Corporation of Wheaton, Ill. The nozzles 96 are rated at preferably about 4 GPM but this may vary depending on the applications. The jet stream spray nozzles 92, however, provide about 2 GPM of flow. Thus, all of the jet stream spray nozzles 96 and 92 provide a total of about 20 GPM's of flow which is a low water usage compared to industry standards, which helps conserve water and enhances the portability of the system. It should be pointed out that water usage could vary along with the nozzle ratings, and still remain within the scope of the present invention. It will be appreciated that it is important to balance the flow through each spray arm 90 such that an approximately equal flow of wash fluid is discharged through each spray arm 90. This helps to maintain articles in an upright position as same pass through the washing chamber 16 and balances the system. It will be appreciated that when each of the spray arms 90 is rotated at a speed of about 400 rpm that every square inch of the surface of the article will be impinged by a jet stream about 8 times as the article is being transported along the conveyor at approximately 3" per second.

The jet stream spray nozzles 96 are further positioned apart by a distance of preferably between about 1 foot–6 feet, and most preferably by a distance of about 4 feet. In this manner articles having an overall height of up to about 4 feet, such as a typical shipping pallet, when positioned end-wise on the conveyor system 64, will be impacted along their full width, and on both sides thereof, by the jet stream sprays emitted from the spray nozzles 96.

The interior sides of a container will also be impacted due to the angle of nozzles and the oscillating spray action of the jet stream emitted by the nozzles. The fixed jet stream spray nozzles 92 are also orientated to direct a jet stream wash spray at the uppermost edge of each article which passes through the washing chamber 16. If after one pass through the washing chamber 16 the opposite edge of the article needs to be cleaned, then the article is rotated such that the side which was face down on the conveyor system 64 during the first pass through the washing chamber 16 is orientated so that it is facing the jet stream spray nozzles 92.

It will also be appreciated that a rotating spray arm such as spray arm 90 having one or more pairs of jet stream spray nozzles could be disposed overhead in the washing chamber 16 instead of the fixed jet stream spray nozzles 92 if desired. Also, it will be appreciated that more than one spray arm assembly 90 could be incorporated on each opposing vertical wall of the washing chamber 16 provided the length of each spray arm and the operation of both are synchronized such that the two spray arms do not contact during operation. Also, as previously discussed, one or more spray arm assemblies could be located below an open conveyor to penetrate the interior of an inverted container with pressurized wash fluid. It will be appreciated, then, that the spray system described herein could be modified if the needs of a specific application require such.

Figure 7:
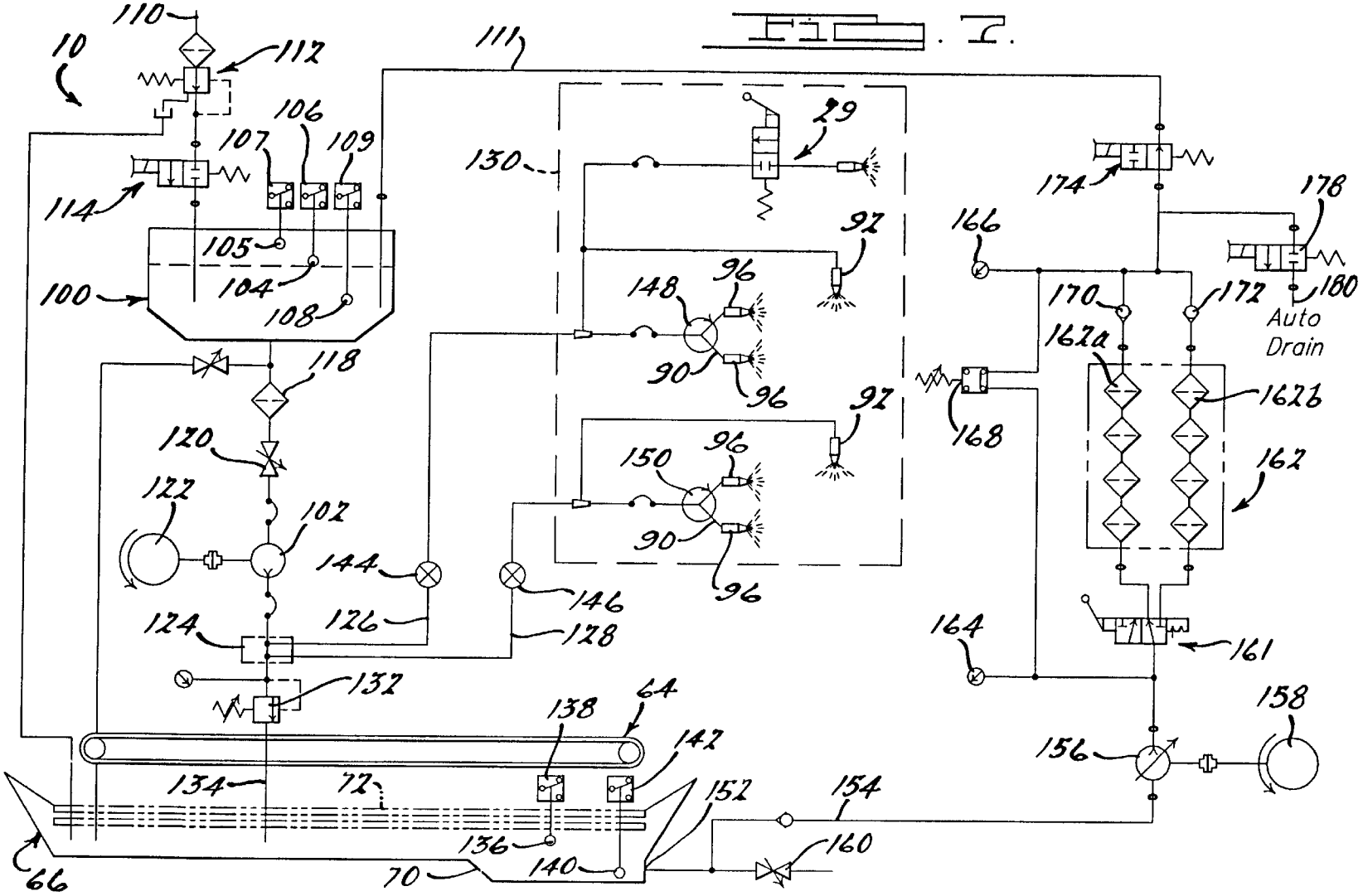
FIG. 7 is a schematic diagram of the apparatus illustrating the interconnection of the various components thereof.
Figure 6:
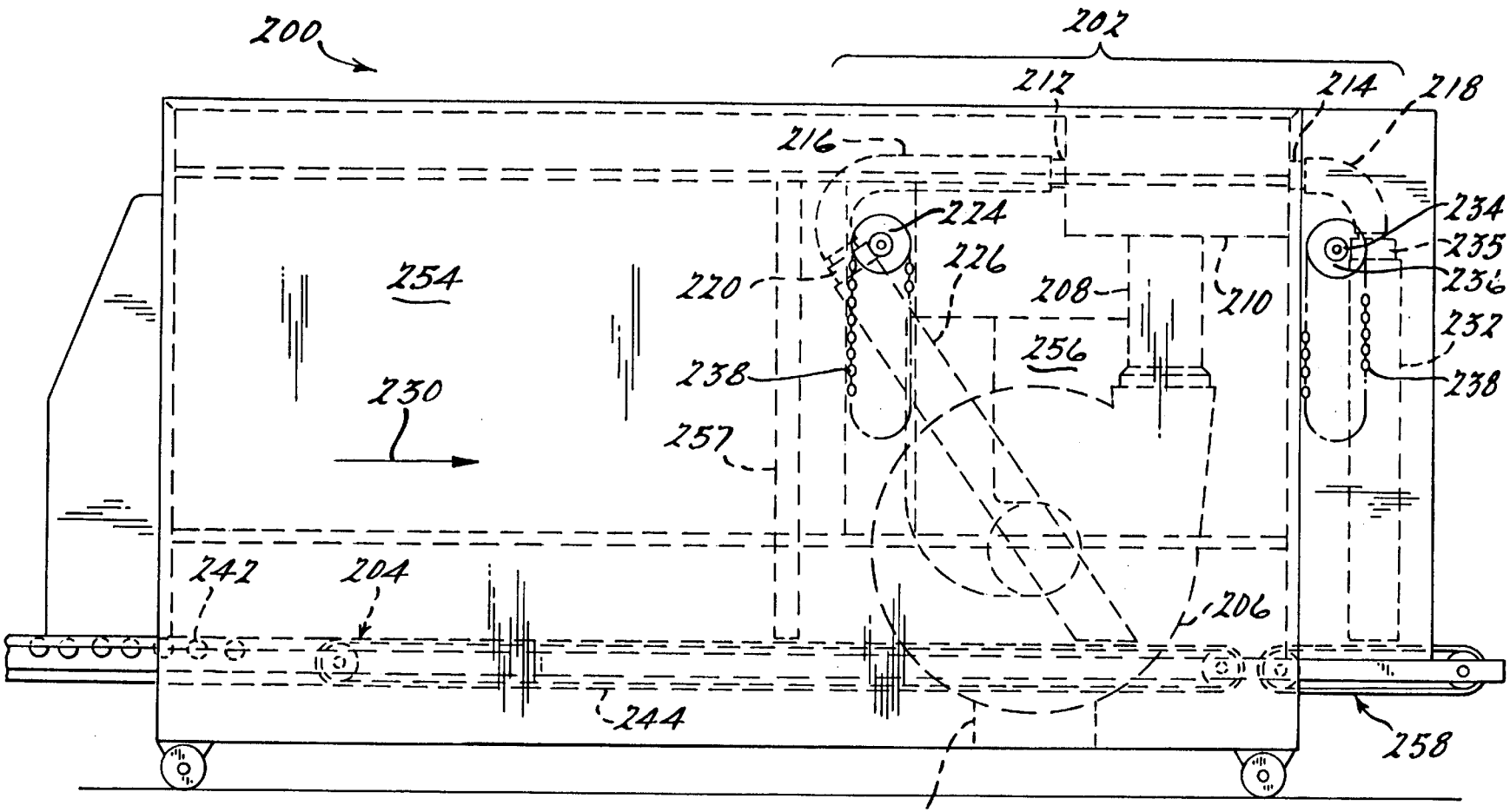

Referring now to FIG. 7, a schematic representation of the apparatus 10 is presented. The clean or fresh wash fluid, which may be water or water treated with desired chemicals, cleaning agents, or other additives is stored in a clean tank 100. The clean tank preferably is an 85 gallon, preferably blow molded, funnel-shaped reservoir designed to provide positive feed (i.e., gravity flow) to a high pressure pump 102. The clean tank 100 preferably also includes an upper level float 104 coupled to a switch 106 for indicating when the fluid level within the tank 100 is at a maximum level, and a lower level float 108 coupled to a switch 109 for indicating when the fluid level within the tank 100 is at a minimum permissible level. A clean tank overfill float 105 indicates that the clean tank is overfilled and actuates a normally closed switch 107 if this condition should occur, which condition shuts down the system through interaction with the PLC 39.

Wash fluid may be pumped into the clean tank 100 via a suitable conduit 111. Alternatively, fresh water can be supplied through a conduit 110 (e.g., a simple ¾" garden hose connector). A first strainer assembly and a ¾" brass backflow preventer 112 is incorporated for preventing back flow out of the tank 100 to prevent any contaminates from entering the fresh water source and also for straining water supplied from a water source before same enters the clean tank 100. An electrically actuated solenoid valve 114 is controlled by the "ENABLE SYSTEM" push-button 46 which is in communication with level switch 109 and float 108 and admits fresh water into the clean tank 100. In the preferred embodiment the maximum quantity of fluid held by the clean tank 100 is about 60 gallons. The minimum level is set at about 40 gallons and the overfill condition will be indicated by the opening of switch 107 when about 70 gallons of fluid accumulate in the clean tank 100, to prevent the actual overflow of the clean tank.

With further reference to FIG. 7, the wash fluid exits the clean tank 100 and passes through another strainer assembly 118 and a manually operable ball valve 120. The ball valve 120 permits the flow of fluid out of the clean tank 100 to be prevented in the event one or more conduits or components down stream of the clean tank 100 require servicing. Once past the valve 120, which is in the open position during normal operation of the apparatus 10, the wash fluid enters the high pressure pump 102. The high pressure pump 102 provides a flow of preferably about 20 GPM at a pressure of preferably about 1400 psi. Pump 102 is driven by an electric motor 122 having a rating of about preferably 20 hp at a speed of about 1800 rpm. The aforementioned ratings may vary depending on the application. The wash fluid then enters a manifold 124 where it is supplied through preferably ¾" stainless steel conduits 126 and 128 to the spray system 130. A pressure relief valve 132 is also in communication with the manifold 124 and opens in the event that the pressure at the input side of the valve 132 exceeds about 1500 psi, or some other designated figure. The relief valve 132 is coupled at its output side with a conduit 134 which drains wash fluid, when the valve 132 is opened, through the strainer assembly 72 and into the collection tank 66. As mentioned previously, the collection tank 66 includes a first float 136 coupled to a normally closed switch 138 which provides a signal indicating that the fluid level in the collection tank 66 is at a maximum level. A second float 140 is also included and coupled to a normally open switch 142 for indicating when the fluid level in the collection tank 66 is at a minimum level. In the preferred embodiment the maximum fluid level in the collection tank 66 is about 40 gallons, although the tank 66 has a capacity of about 60 gallons. All above described functions are controlled by the PLC.

With further reference to FIG. 7, flow meters 144 and 146 are provided in the conduits which supply wash fluid to the spray system 130 and are monitored by the PLC 39. The flow meters 144 and 146 provide a visual indication of the gallons per minute (GPM) flow to the spray nozzles 96 and 92. Each pair of spray nozzles 96, as mentioned previously, is rotated by an independent motor 148 and 150, respectively. The motors 148 and 150 are approximately 1 HP motors which rotate each spray arm 90 (FIG. 4) at preferably about 400 rpm. The entire output from the spray nozzles 92 and 96 is collected in the collection tank 66.

Contaminant-entrained wash fluid collected in the collection tank 66 is pumped out of the tank 66 through an outlet 152 into a conduit 154 by a reclamation pump (i.e., waste pump) 156. The pump 156 is a 20 GPM pump which is driven by a 0.75 HP, 3600 rpm motor 158. Alternatively, fluid can be drained from the collection tank 66 by manually opening up a valve 160. Of course, it will be appreciated that whenever the collection tank 66 is to be drained, the apparatus 10 will need to be connected to a drainage hose and disposed near a drain for drainage.

With further reference to FIG. 7, the reclamation pump 156 pumps the contaminant-entrained wash fluid through a manual three-way valve 161 to a filter assembly 162. The filter assembly 162 is comprised of two rows of one or more independent filter housings 162(*a*) and 162(*b*) coupled in parallel with one another. Each housing has a disposable interior filter bag rated at one of several nominal microratings, depending on the level of filtration that is required. The parallel coupling, in connection with the three way manual valve 161, permits the entire flow of contaminant-entrained (wash fluid to be directed toward one or the other rows of filter housings 162(*a*) or 162(*b*). This will allow the filter bags to be removed and replaced in the row of filter housings not receiving the depicted flow of contaminant-entrained wash. Clogging of the filter bags in filter housings 162*a*, 162*b* is detected by the PLC 39 monitoring the pressure via a pressure sensor 168 which reads the incoming and outgoing pressure through the filter assemblies 162(*a*) and 162(*b*) and is displayed as a non-critical fault on digital display screen for the operator's benefit. There is also two visual pressure gauges, one for incoming pressure 164 and one for outgoing pressure 166. Also, check ball valves 170 and 172 are disposed on the output sides of the filters 162*a*, 162*b*, respectively, to prevent the backflow of fluid into the filter assembly 162. It is also possible to employ self-cleaning filter assemblies for applications where it is anticipated that the filters may be required to be cleaned very frequently.

After leaving the filter assembly 162, the filtered wash fluid is pumped through a solenoid valve 174, into the conduit 111, and back into the clean tank 100. Alternatively, if the wash fluid is to be drained from the apparatus 10 via the automatic drain routine, then the PLC 39 causes valve 174 to be actuated, interrupting the flow of wash fluid to the conduit 111, while a second valve 178 is simultaneously opened by the PLC 39, permitting fluid flow therethrough to a conduit 180 through the filters leading to a drain. During normal operation of the apparatus 10, valve 178 is closed to prevent fluid flow therethrough while valve 174 is open.

Referring now to FIGS. 3 and 7, to start the apparatus 10 the switch 32 (FIG. 3) is turned to the "ON" position and the MASTER START AND RESTART pushbutton 42 is pressed. This causes the PLC 39 to perform a series of automatic, internal checks to detect any potential problems or malfunctions with the apparatus 10. Any detected problems or error conditions are displayed on the LCD display 62*a*. Detected problems could encompass insufficient or excessive water levels in the clean tank 100, motor overload conditions, etc. The operator next presses the "ENABLE SYSTEM" button 46. If the apparatus 10 is being used for the first time or if the fluid level in the clean tank 100 is sensed as being below the maximum level of about 60 gallons, a message indicating such will be provided on the LCD display 62*a*. The "SYSTEM NOT READY" LED 38 will also be illuminated and the PLC 39 will turn on solenoid valve 114 in an attempt to admit "make-up" water into the clear tank 100. Of course, if conduit 110 is not coupled to a water supply, then no water will be admitted, and the PLC 39 will detect this if the detected fluid level does not change within about 90 seconds. A message will then be provided on the LCD display 62*a* indicating a low water condition. If the fluid level in the clean tank 100 is less than about 40 gallons, the LCD display 62*a* will indicate that the fluid level is too low for operation. In this instance, the PLC 39 prevents the apparatus 10 from being operated until the clean tank 100 is filled to at least the 40 gallon mark. When the clean tank 100 is detected as being sufficiently filled, the "SYSTEM READY" light 40 is illuminated.

At this point the operator adjusts the independent guide rail assemblies 76 to the proper spacing to properly support and orientate the articles to be washed. Once the guide rail assemblies 76 are adjusted the operator selects the conveyor speed via three position switch 58. After selecting the conveyor speed, the operator presses the "START CONVEYOR" pushbutton 44 which causes the conveyor system 64 to be driven at the selected speed. At this point no wash fluid will be supplied to the spray system 130, the spinner arms will not be rotating, and the fans will be off. When the detection system 21 (FIG. 1) detects the presence of an article, the PLC 39 activates the high pressure pump 102 which supplies wash fluid under a pressure of about 1400 psi to each spray arm 90. At this instant the motors 148 and 150 which drive each spinner arm 90 are turned on by the PLC 39 causing the spray arms 90 to rotate quickly up to a speed of about 400 rpm. The blower fans will also be turned on at this point. The PLC 39 is also programmed to turn off the high pressure pump 102, the motor for the spinner arms and the blower for the fans 24, if a time period of between about 30 seconds–1 minute passes without another article being sensed by the detection system 21. In this event, the conveyor system 64 will continue to run but no wash fluid will be supplied to the spray system 130. As soon as another article is detected, however, the pump 102 will be restarted together with the motors 148 associated with each spray arm 90, and the blowers for the fans. Although not absolutely essential, this feature saves energy, conserves wash fluid and saves on wear and tear on the various components of the apparatus 10 if long intervals are frequently encountered as articles are loaded into the apparatus 10 for washing.

With further reference to FIGS. 3 and 7, at the end of the day or when it is desired to power down the apparatus 10, the operator presses the "SHUT DOWN SYSTEM" pushbutton 52. The PLC 39 turns off the high pressure pump 102 and the motors 148 and 150 driving the spray arms 90, and the conveyor motor is turned off and the blower for the fans are turned off. The reclamation pump 156, however, continues to run until the collection tank 66 is indicated as being completely empty by float 140 and level switch 142. At this point the pump 156 is turned off automatically by the PLC 39. The fan assemblies 24 may also be turned off via the rotary switch 56. In an emergency, the "EMERGENCY STOP" pushbutton 60 may be pressed which immediately stops all of the pumps and motors of the apparatus 10. Lastly, the switch 32 is switched to the "OFF" position.

If during operation of the apparatus 10 or while the apparatus 10 is powered on but not operating, it is desired to change the supply of wash fluid in the clean tank 100, the operator presses the "DRAIN SYSTEM" button 48 and the PLC 39 will maintain the high pressure pump 102 turned on such that the wash fluid continues to be pumped to the rotating spray nozzles 96 and 92 until the clean tank is empty, at which point the high pressure will be shut off. The reclamation pump 156 pumps the entire quantity of wash fluid received in the collection tank 66 through the filter assembly 162. At this point the PLC 39 turns on valve 178 and turns off valve 174. This directs the entire quantity of fluid flow from the filter assembly 162 out of conduit 180 to an external drain. It will be appreciated that a suitable drainage hose is coupled to conduit 180 via a standard threaded or other like coupling to direct the discharged wash fluid directly to the external drain. The low level float 108 and level switch 109 provide a signal to the PLC 39 indicating when the fluid level in the clean tank 100 is at the minimum level. At this point the PLC 39 turns off the high pressure pump 102, and water flow through the spinner arms (90) will be discontinued along with the rotation of spinner arms (90). The reclamation pump 156 will continue to run until the low level float 140 and level switch 142 provide a signal to the PLC 39 that the fluid level in the collection tank is at the minimum level. At this point the PLC 39 turns off the reclamation pump 156, and closes valve 178 and reopens valve 174, and the auto drain sequence is complete. The clean tank 100 can then be refilled with fresh water by depressing the enable system button 46 causing the PLC 39 to open valve 114 admitting fresh water into the clean tank 100. It will be appreciated that a principal advantage of the apparatus 10 is therefore its ability to repeatedly impart, by means of a rapidly rotating spinner arm assembly, a high pressure jet stream of washing fluid over the entire surface area of an article as it is transported at up to 3" per second along a powered conveyor without the need for heating the washing fluid. The ability to clean without heating the washing fluid not only saves power but allows the apparatus 10 to be used with a conventional electrical service, which may not otherwise be possible with systems having boilers or other heating assemblies requiring high electrical current for operation. The ability to clean without heating the fluid also increases the efficiency and throughput of the apparatus 10 because large numbers of articles can be cleaned, one after another, without waiting for the wash fluid to be heated or recharged. The exceptionally strong, knife-like scrubbing action provided by the spray system 139 effectively blasts contaminants off the surfaces of the articles being cleaned normally without the need for solvents or chemicals through the above-described knife-like lifting action provided by the high pressure jet stream spray nozzles 96 and 92. The fan assemblies 24 serve to substantially dry the articles allowing those articles to be stacked or to be immediately put back into service. Drying also minimizes the water that is carried away from the apparatus 10 and deposited on the floor surface surrounding the apparatus 10.

The closed-loop water reclamation system of the apparatus 10 further enables the water to be recycled and re-used so that the apparatus 10 does not require immediate or constant access to a drain, and it may therefore be used in areas of a building, plant or factory where a fresh water supply conduit may not be readily available. Since the apparatus 10 is readily movable by the casters 12*a* or lifted by a fork-lift, the apparatus 10 can be quickly and relatively easily relocated to a desired area of a plant, factory or other building where the articles to be cleaned are located. The closed-loop water reclamation system also filters the contaminant-entrained wash fluid such that contaminants are not discharged from the apparatus 10 to a drain or into the ground water. This prevents potentially harmful contaminants from entering a community's waste water treatment system or into the ground water table. When the wash fluid becomes significantly spent or dirty, the automatic drain routine of the apparatus 10 permits the recycled wash fluid, which has been continuously filtered, to be quickly and easily drained from the apparatus 10 without the need to couple or uncouple multiple sections of conduits; the only coupling that may be required is to a hose which is simply connected to a conduit of the apparatus 10 to permit the wash fluid to be directed to an external drain. Recharging the clean tank 100 of the apparatus 10 is also simple and merely requires coupling a conduit or hose to a fresh water supply source and pressing a single button on the control panel 14. While the system is designed to operate effectively with water as the wash fluid, supplemental detergents, rinse agents, additives, insecticides, or anti-bacterial agents or other chemicals may be injected into the wash fluid via a small metering pump to aid in cleaning or to provide additional benefits. The supplemental agent is rationed at a predetermined recommended percentage mix into the water, and is only added when fresh water is put into the system, so the proportional mix is consistently maintained at all times.

With its extremely high and consistently effective throughput, the apparatus 10 significantly reduces the man-hours required to clean any given quantity of pallets, totes, containers, bins, trays, receptacles, carts and other like articles. Additionally, the apparatus 10, through the logical lay out of the control panel 14, allows individuals to be quickly taught how to use the apparatus 10. Faults and error conditions are quickly displayed in simple terms and help the operator to correct or remove the fault condition so that operation of the apparatus 10 can be continued. The washing apparatus also allows for the consistent and thorough cleaning of an article and eliminates the inconsistent cleaning action found with cleaning by hand or spray power wash, or with other previously developed washing systems.

Referring now to FIG. 8, a pallet washing and drying apparatus 200 in accordance with an alternative preferred embodiment of the present invention is shown. The apparatus 200 is substantially identical to the apparatus 10 with the exception of a much more powerful drying system, denoted by reference numeral 202, and a modified conveyor assembly 204. The drying system 202 generally comprises a 40hp motor 204 which supplies power to a blower assembly 206. The blower assembly 206 generates an extremely powerful airflow, on the order of about 30,000 cfm, which is output through suitable tubing 208 to a plenum 210. The plenum 210 has a first pair of outputs 212 and a second pair of outputs 214 (only one of each being visible in the side view of FIG. 8).

Figure 9:
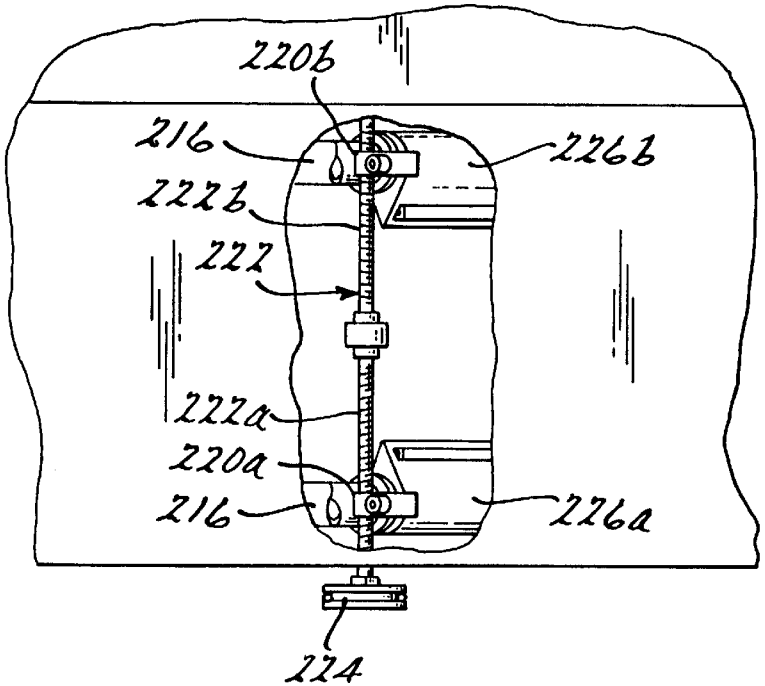
FIG. 9 is a cut away plan view of a top portion of the embodiment of FIG. 8 illustrating the coupling of the air knives to a threaded support member.

With reference to FIGS. 8 and 9, outputs 212 are coupled to independent sections of flexible tubing 216. Likewise, the outputs 214 are coupled to independent sections of flexible tubing 218. With further specific reference to FIG. 9, each of tubing sections 216 are coupled to coupling members 220*a* and 220*b* which are threadably disposed on a horizontally extending support shaft 222. It will be appreciated immediately that a first portion 222*a* of the support shaft 222 includes a right hand thread while a second portion 222*b* includes a left handed thread. A pulley 224 is fixedly mounted to an end of the support shaft 222.

With further reference to FIG. 9, also attached to each coupling member 220*a* and 220*b* is an air knife fan assembly 226*a* and 226*b*. Each of the air knives receive a powerful air flow from the plenum 210 and generate two very powerful columns of air which are used to effectively blast off moisture from outer surfaces of pallets, totes, trays and other like articles as the articles are moved past and between the air knives 226*a*–226*b*. Referring again to FIG. 8, each of the air knives 226 are mounted via the coupling members 220 such that they hang freely at an angle of preferably between about 25°–75°. When pallets, trays or other like articles are carried through the apparatus 200 in the direction of arrow 230, a powerful, knife-like column of air produced by each of the air knives 226 effectively blasts water and moisture off of each article and towards the conveyor assembly 204. A second pair of air knives 232 (only one being visible in the side view of FIG. 8) are mounted vertically and also attached to a horizontally extending support member 234 via couplings 235 (only one being visible in FIG. 8) which permit each air knife 232 to hang freely in a vertical or nearly vertical orientation. The horizontal support shaft 234 is also coupled to a pulley 236 which has entrained therearound a chain 238. Since the support member 234 includes left and right handed threads as described in connection with the support member 222 in FIG. 9, the spacing between each of the air knives 232 can be adjusted by pulling on the chain 238 and rotating the pulley 236 either clockwise or counterclockwise, thus causing the pulley 236 to be rotated. Rotating the pulley 236 in one direction will cause the air knives 232 to be drawn closer to each other while rotating the pulley 236 in the opposite direction will cause the air knives 232 to be urged away from each other. The same operation applies to the pulley 224 and chain 228. In this matter, both pairs of air knives 226 and 232 can be adjusted to bring each pair closer to or farther from one another. In this manner, the air knives 226 and 232 can be manually adjusted to be very close to the outer surfaces of the articles as same pass between the air knives 226 and 232.

It will also be appreciated that while the drying system 202 is shown as an integral portion of the apparatus 200, that the drying system could be formed as an independent modular system which is readily attachable and detachable from the remainder of the apparatus 200. The use of one or more pairs of powerful air knives provides extremely effective drying of the articles which pass between the air knives 226 and 232. The adjustability of the air knives 226 and 232 enables articles having widely varying dimensions to be accommodated through quick, minor adjustments of the spacing of the air knives 226 and 232 via the chains 228 and 238.

Figure 10:
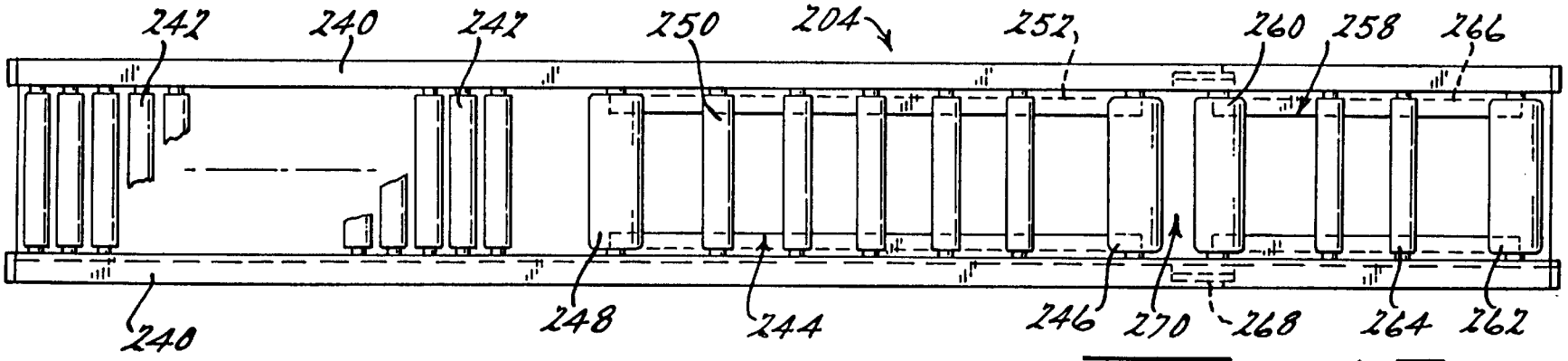
FIG. 10 is a plan view of the conveyor assembly used in the embodiment of FIGS. 8 and 9.

Referring now to FIG. 10, the conveyor system 204 is shown in greater detail. The conveyor system 204 includes a pair of elongated frame rails 240. Disposed rotatably between the frame rails 240 is a plurality of non-powered rollers 242 which permit an operator to set a pallet, tote or other like article thereon before feeding the article into the apparatus 200. An intermediate section 244 is composed of a pair of drums 246 and 248 and a plurality of non-powered rollers 250. Around the drums 246 and 248 and the non-powered rollers 250 is entrained a conveyor belt 252. The intermediate conveyor assembly 244 is used to move articles which have been fed into the apparatus 200 for washing through a wash chamber of the apparatus, denoted generally by reference numeral 254 in FIG. 8, and into a drying chamber, denoted by reference numeral 256 in FIG. 8. The washing chamber 254 is separated from the drying chamber 256 by one or more brush assemblies 257 such as brush assembly 18 in FIG. 2.

With further reference to FIG. 10, an output conveyor section 258 is formed by a pair of drums 260 and 262 and in a plurality of non-powered rollers 264. A separate conveyor belt 266 is entrained around the drums 260 and 262. Drum 260 and drum 246 are also intercoupled by suitable gears 268 such that both are driven rotationally in the same direction by a motor associated therewith.

From FIG. 10 it will be noted that a distinct gap 270 exists between the drums 246 and 260. This gap 270 or spacing permits washing fluid accumulated on the conveyor belt 252 to run off into the collection tank 66 (FIG. 5) so that same is not carried out of the apparatus 200. It will be appreciated that one or more non-powered rollers could easily be placed in the area of gap 270 if desired.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. Apparatus for cleaning articles such as pallets, totes, containers land other like handleable item supporting structures, said apparatus comprising:

a main housing defining a washing chamber, a conveyor for carrying said articles Into and through said washing chamber;

a spray system for directing a wash fluid under pressure at surfaces of said articles once said articles are disposed inside said chamber to remove contaminants from said articles;

said spray system including:

a conduit forming a spray arm having a pair of spray nozzles;

a wash fluid reservoir for holding a quantity of said wash fluid;

a high pressure pump for causing said wash fluid to be supplied to said spray arm under a high pressure, whereby said spray nozzles produce a plurality of high pressure jet streams of said wash fluid; and a system for driving said spray arm rotationally at a speed of between about 100 rpm–800 rpm to produce a plurality of moving jet streams; and a system for filtering and recycling said wash fluid for re-use and for pumping said filtered wash fluid back into said wash fluid reservoir.

2. The apparatus of claim 1, further comprising at least one fan disposed adjacent to said washing chamber for providing an airflow directed at said articles as said articles exit said washing chamber for removing water from said articles.

3. The apparatus of claim 2, further comprising a brush disposed adjacent said washing chamber for helping to maintain said wash fluid within said chamber during operation of said apparatus.

4. The apparatus of claim 1, wherein said high pressure pump for supplying said wash fluid under a high pressure to said spray system supplies said wash fluid at a pressure of at least about 1000 psi.

5. The apparatus of claim 1, further comprising:

a manually adjustable guide rail assembly for maintaining said articles in an upright orientation as said articles move through said washing chamber on said conveyor.

6. The apparatus of claim 5, wherein said system for filtering and recycling said wash fluid further comprises:

a strainer assembly disposed below said conveyor for straining contaminant-entrained wash fluid before said wash fluid is recycled for use by said system for recycling said wash fluid.

7. Apparatus for cleaning articles such as pallets, totes, containers and other like structures, said apparatus comprising:

a main housing defining in part a washing chamber;

a conveyor for conveying said articles into and through said washing chamber;

a guide rail assembly positioned within said washing chamber and extending at least partially out of said washing chamber adjacent an inlet side of said washing chamber for supporting said articles in a desired orientation as said articles are carried through said washing chamber by said conveyor;

a spray system for directing a wash fluid under pressure at surfaces of said articles once said articles are disposed inside said wash chamber to remove contaminants on said articles;

a wash fluid collection tank for collecting contaminant-entrained wash fluid within said washing chamber;

a filter assembly for filtering said contaminant-entrained wash fluid to remove said contaminants therefrom;

a container for holding clean, filtered wash fluid;

a first pump for pumping said clean, filtered wash fluid from said filter assembly to said container; and a second high pressure pump for pumping said clean, filtered wash fluid from said container to said spray system, whereby said spray system, said container, said filter and said collection tank form a closed-loop water filtering and reclamation system.

8. The apparatus of claim 7, wherein said guide rail assembly comprises a pair of manually adjustable guide rails for accommodating articles having various dimensions.

9. The apparatus of claim 7, wherein said spray system comprises:

a tubular spray arm having a pair of jet-stream nozzles disposed at opposite ends thereof such that said jet-stream nozzles are spaced apart from one another by a distance of at least about three feet;

a motor for rotating said spray arm assembly at a speed of between about 100 rpm–800 rpm; and a high pressure fluid pump for supplying said wash fluid to said spray arm at a pressure of between about 1,000 psi–1600 psi; and wherein said jet-stream nozzles are disposed on said spray arm such that said jet-stream nozzles direct a concentrated jet-stream of said wash fluid at an angle of preferably about 10°–30° relative to an outer surface of said article.

10. The apparatus of claim 9, further comprising:

a pair of said spray arms, each one of said spray arms disposed on an opposite side of said washing chamber to direct said wash fluid against opposite sides of said articles as said articles are moved through said wash chamber by said conveyor; and at least one fluid nozzle disposed within said wash chamber to direct wash fluid downwardly from an upper area of said wash chamber onto said articles as said articles are moved through said wash chamber by said conveyor.

11. The apparatus of claim 7, further comprising at least one fan disposed adjacent an outlet side of said washing chamber for directing an air stream against said articles as said articles exit said washing chamber to thereby help dry said articles quickly.

12. The apparatus of claim 7, further comprising:

a first brush assembly disposed adjacent said inlet side of said wash chamber; and a second brush assembly disposed adjacent an outlet side of said washing chamber;

said first and second brush assemblies serving to help maintain said wash fluid contained within said washing chamber during operation of said apparatus.

13. The apparatus of claim 7, wherein said filter assembly comprises:

a conduit for supplying said contaminant-entrained wash fluid from said collection tank to said filter assembly;

a first filter and a second filter disposed in parallel with said conduit; and a manual valve assembly for selectively blocking the flow of said contaminant-entrained water to one or the other of said first and second filters for enabling one or the other of said first and second filters to be cleaned while the other one of said first and second filters remains operable.

14. The apparatus of claim 7, further comprising:

a detection system for detecting the entry of one of said articles into said washing chamber;

a high pressure pump for supplying said wash fluid to said spray assembly under a pressure of between about 1,000 psi–1,800 psi; and a controller for controlling said high pressure pump such that said pump is not actuated until said detection system detects the presence of one of said articles.

15. The apparatus of claim 7, further comprising a conduit for communicating fresh wash fluid from a fluid source into said container; and a first strainer assembly for filtering said fresh wash fluid prior to said fresh wash fluid entering said container; and a second strainer disposed between said collection tank and said filter assembly for straining contaminants from said contaminant-entrained wash fluid prior to said contaminant-entrained wash fluid entering said filter assembly.

16. Apparatus for cleaning articles such as pallets, totes, containers, trays, arts and other like structures, said apparatus comprising:

a main housing defining a washing chamber;

a conveyor for carrying said articles into and through said washing chamber;

a container for holding a quantity of a wash fluid;

a spray system for directing said wash fluid under pressure at a plurality of surfaces of said articles once said articles are disposed inside said wash chamber to remove contaminants from said articles;

said spray system including a plurality of moving spray nozzles for producing a plurality of jet streams of said wash fluid which impinge said surfaces of said articles a plurality of times as said articles are moved through said washing chamber by said conveyor;

a collection tank for collecting and temporarily holding contaminant-entrained wash fluid;

a filter assembly for filtering said contaminant-entrained wash fluid to produce a filtered wash fluid; and a pump for pumping said filtered wash fluid back into said container for re-use.

17. The apparatus of claim 16, further comprising a pair of guide rails extending into said washing chamber and extending outwardly of said washing chamber at an inlet end of said main housing, said guide rails being adjustable in spacing relative to one another to accommodate articles of varying dimensions.

18. The apparatus of claim 16, further comprising:

a blower assembly disposed at an outlet end of said main housing adjacent said washing chamber for producing a column of air for at least partially drying said articles as said articles exit said washing chamber.

19. The apparatus of claim 16, further comprising:

a detection system for detecting the entry of a portion of said article into said washing chamber;

a controller for controlling said apparatus and for turning on said spray system once said detection system detects the entry of one of said articles in said washing chamber; and wherein said controller operates to turn off said spray system after a predetermined time during which said detection system does not detect the entry of one of said articles into said washing chamber.

20. The apparatus of claim 16, wherein said spray system comprises a pair of spray arms, each one of said spray arms including a pair of spray nozzles spaced apart from one another by a distance of at least about three feet, and a motor associated with each one of said spray arms for rotating each said spray arm at a speed of between about 100 rpm–800 rpm.

21. The apparatus of claim 20, wherein each of said spray nozzles is orientated to provide a jet stream of said wash fluid against a surface of said article at an angle of between about 5°–45° relative to said surface of said article.

22. The apparatus of claim 16, wherein said filter system comprises first and second filter assemblies coupled in parallel with a first conduit communicating with said collection tank and a second conduit communicating with said container; and a valve system for allowing one of said first or second filters to be removed from a flow path of said contaminant-entrained wash fluid without affecting the operation of the other one of said first and second filter assemblies.

23. The apparatus of claim 16, wherein said spray system comprises at least one spray nozzle disposed in an upper area of said washing chamber for directing a portion of said wash fluid down onto said articles as said articles are moved through said washing chamber by said conveyor.

24. An apparatus for cleaning articles such as pallets, totes, containers, trays, carts and like articles, said apparatus comprising:

a main housing having a washing chamber;

a conveyor for moving said articles through said washing chamber;

a first reservoir for holding a quantity of said wash fluid;

a spray system in communication with said first reservoir for applying said wash fluid in the form of a plurality of jet spray streams to said articles as said articles are moved through said washing chamber by said conveyor;

a first pump for supplying said wash fluid from said first reservoir to said spray system under a high pressure;

a second reservoir for collecting contaminant-entrained wash fluid;

a filter assembly for filtering said contaminant-entrained wash fluid to produce a filtered wash fluid; and a second pump for pumping said filtered wash fluid back to said first reservoir for reuse.

25. Apparatus for cleaning articles such as pallets, totes, containers and other like structures, said apparatus comprising:

a main housing defining a washing chamber;

a conveyor for carrying said articles into and through said washing chamber;

a spray system for directing wash fluid under pressure at surfaces of said articles once said articles are disposed inside said chamber to remove contaminants from said articles; and a system for recycling said wash fluid for re-use including:

a collection tank for collecting contaminant-entrained wash fluid within said washing chamber;

a filter system for filtering contaminants from said contaminant-entrained wash fluid;

a clean wash fluid reservoir in communication with said filter assembly; and a pump for pumping filtered wash fluid back to said clean wash fluid reservoir for reuse.

26. Apparatus for cleaning articles such as pallets, totes, containers and other like structures, said apparatus comprising:

a main housing defining a washing chamber;

a conveyor for carrying said articles into and through said washing chamber, a spray system for directing a wash fluid under pressure at surfaces of said articles once said articles are disposed inside said chamber to remove contaminants from said articles;

said spray system including:

a conduit forming a spray arm having at least one spray nozzle;

a high pressure pump for causing a clean wash fluid to be supplied to said spray arm under a high pressure, whereby said spray nozzle produces a high pressure jet stream of said wash fluid;

a system for driving said spray arm rotationally to produce a rotationally moving jet stream;

a system for recycling contaminated wash fluid for re-use, including:

a collection tank for collecting contaminant-entrained wash fluid within said washing chamber;

a filter system for filtering contaminants from said contaminant-entrained wash fluid;

a clean wash fluid reservoir in communication with said filter assembly; and a pump for pumping filtered wash fluid back to said clean wash fluid reservoir for reuse.

* * * * *